United States Patent [19]

Work

[11] 4,253,220

[45] Mar. 3, 1981

[54] BURIAL VAULTS

[75] Inventor: Gerald L. Work, Spokane, Wash.

[73] Assignee: Wilbert, Inc., Forest Park, Ill.

[21] Appl. No.: 47,983

[22] Filed: Jun. 13, 1979

[51] Int. Cl.[3] ..... A61G 17/00

[52] U.S. Cl. ..... 27/35; 27/7

[58] Field of Search ..... 27/35, 2, 7, 10

[56] References Cited

U.S. PATENT DOCUMENTS

| | | | |
|---|---|---|---|
| 1,705,410 | 3/1929 | Laidlaw | 27/35 |
| 1,727,242 | 9/1929 | McKee | 27/35 |
| 3,172,183 | 3/1965 | Bugg | 27/35 X |
| 3,208,188 | 9/1965 | Fulton et al. | 27/2 X |
| 3,868,799 | 3/1975 | Hayward | 27/2 X |
| 3,997,949 | 12/1976 | Waltz | 27/2 |
| 4,174,556 | 11/1979 | Richings | 27/7 |

*Primary Examiner*—John D. Yasko

*Attorney, Agent, or Firm*—Charles B. Cannon

[57] ABSTRACT

A burial vault including a base and a cover or dome molded from moldable plastic resinous material. The base and cover or dome have reinforcing ribs formed integrally therewith on the inner surfaces of the side and end walls thereof. The base has a pattern of reticulated reinforcing ribs formed integrally with and on the inner surface of the bottom of the base, and the cover or dome has a comparable pattern of reticulated reinforcing ribs formed integrally with and on the inner or lower surface of the top wall of the cover or dome, and the base has reinforcing structures formed integrally therewith at the bottom corners of the base. The base and the cover or dome have reinforcing ribs formed on the inner surfaces of the side and end walls thereof. The base and the cover or dome have outwardly projecting marginal or peripheral sealing flanges formed integrally therein at the upper and lower edges thereof, respectively, and these sealing flanges have mating and coacting sealing tongues and grooves formed therein. At least certain of the walls of the base and the cover or dome have geometrically shaped recesses formed in the outer surfaces thereof and these recesses are adapted to receive correspondingly geometrically shaped decorative colored panels or inserts adhesively mounted therein. At least certain of the reinforcing ribs on the inner surfaces of the side walls of the base and the dome or cover have coacting latching grooves and tongues formed therein for securely latching the base and the cover or dome together in assembled relationship.

4 Claims, 13 Drawing Figures

BURIAL VAULTS

BACKGROUND OF THE INVENTION

Molded plastic resinous burial vaults have been known heretofore and the prior art of such vaults is represented by U.S. Pat. Nos. 3,208,186 and 3,208,188 and certain of the references cited therein. However, molded plastic resinous burial vaults have, in many instances, not been entirely satisfactory due, in some instances, to lack of adequate structural strength, lack of proper sealing, and other deficiencies.

OBJECTS OF THE INVENTION

An object of the present invention is to provide a new and improved molded plastic resinous burial vault which includes a base having a novel arrangement and pattern of reticulated reinforcing ribs formed integrally with and on the upper surface of the base of the vault and on the inner surface of the cover or dome of the vault.

Another object of the invention is to provide a novel arrangement of reinforcing ribs formed integrally with and on the inner surfaces of the side and end walls of the base and on the cover or dome of the vault and which coact to provide a molded plastic resinous burial vault which has high structural strength and resistance to the weight of the overlying earth load when in the grave opening and the crushing forces of cemetery machinery moving thereover.

Another object of the invention is to provide in the new molded plastic resinous burial vault novel coacting outwardly extending marginal or peripheral sealing flanges and sealing arrangements on the upper marginal edges of the base and the bottom marginal edges of the cover or dome of the vault.

A further object of the invention is to provide in the side and end walls of the base and in the cover or dome of the new molded plastic resinous burial vault geometrically shaped recesses into which correspondingly shaped decorative panels or inserts may be adhesively mounted to enhance the ornamental appearance and decorative effect of the new burial vault.

An additional object of the invention is to provide a molded plastic resinous burial vault which is an improvement over prior molded plastic resinous burial vaults in having greater structural strength, better sealing arrangement between the base and the cover or dome of the vault, more attractive decorative appearance, and other desirable characteristics.

Additional objects of the invention are (1) to provide in the new vault a new and improved pattern of reticulated reinforcing ribs on the upper surface of the bottom wall of the base of the vault; (2) to provide a novel and improved pattern of reticulated reinforcing ribs on the inner surface of the top wall of the dome; (3) to provide a novel arrangement and construction of reinforcing ribs on the side and end walls of the base and the cover or dome of the new vault; (4) to provide a novel reinforcing construction at the bottom corners of the base of the vault; and (5) to provide a novel arrangement of coacting latching means on at least certain of the reinforcing ribs on the side walls of the base and the side walls of the cover or dome of the vault for securely latching the base and the cover or dome of the vault together in assembled relationship.

Other objects will appear hereinafter.

DESCRIPTION OF FIGURES IN THE DRAWINGS

Figure 3:
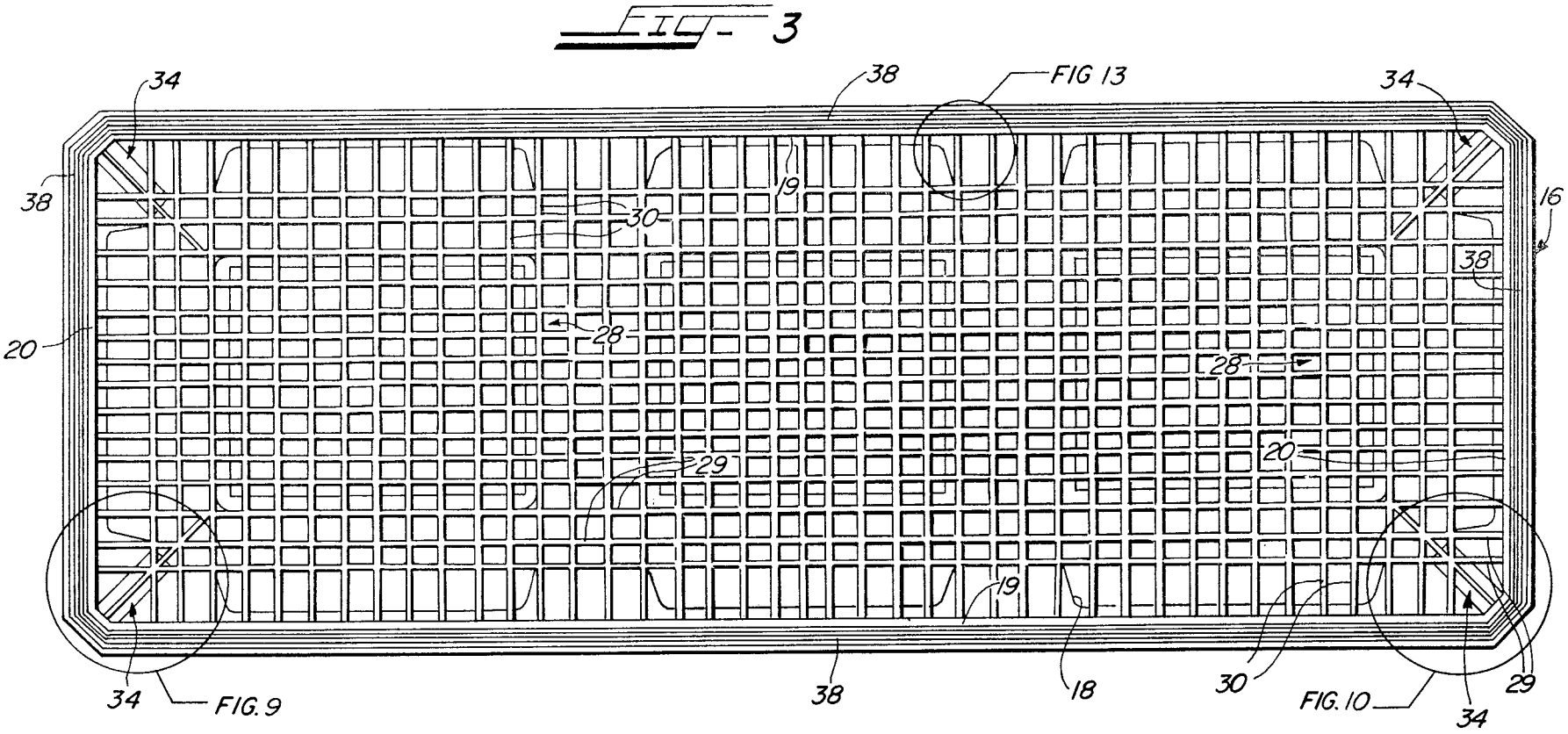
FIG. 3 is a fragmentary top plan view of the base of the vault, on line 3—3 in FIG. 2, illustrating the reticulated reinforcing structure of the inner surfaces of the bottom, side and end walls of the base.
Figure 4:
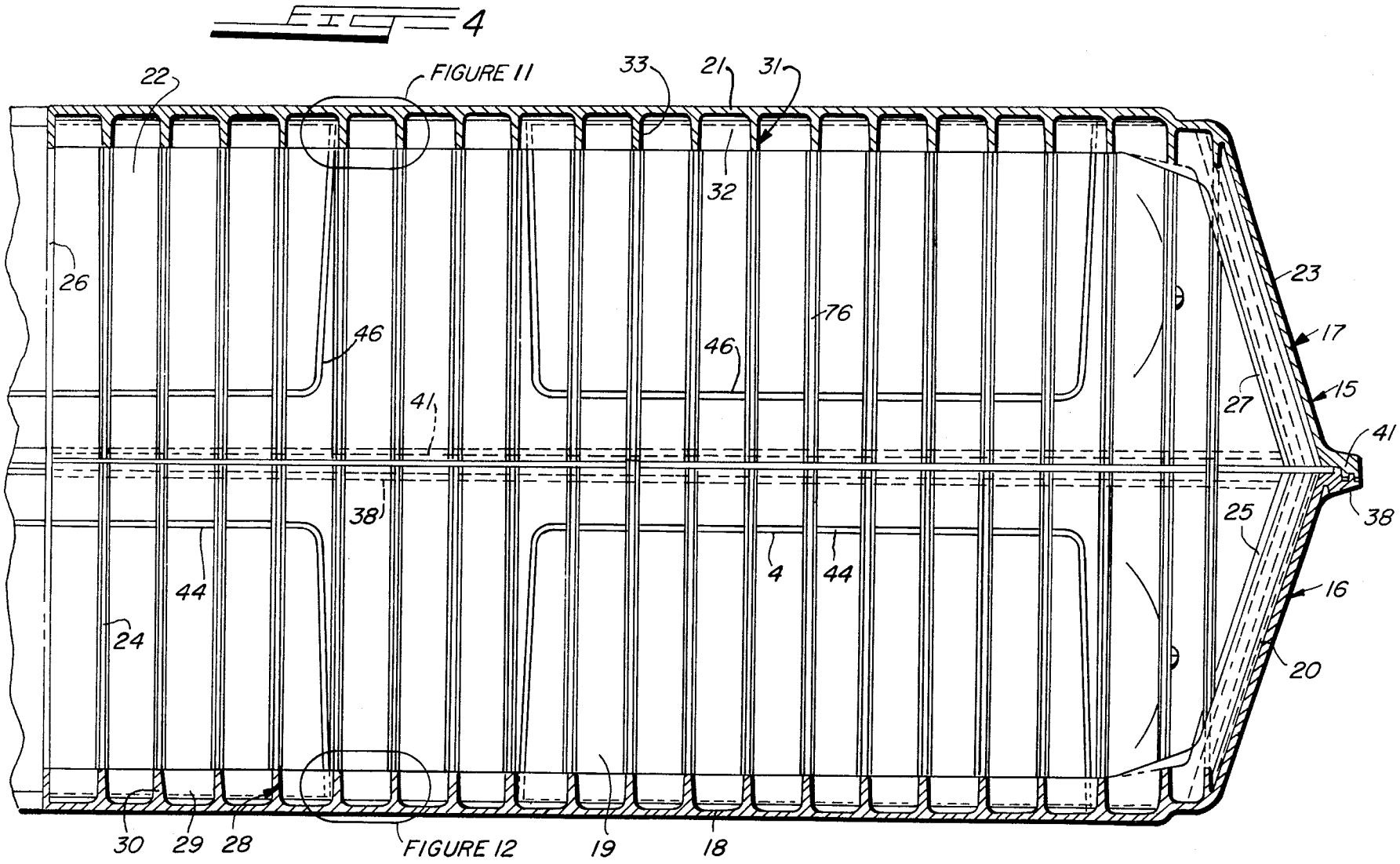
FIG. 4 is an enlarged fragmentary sectional detail view on line 4—4 in FIG. 3 illustrating parts of the base of the new vault and the pattern of reticulated reinforcing ribs on the inner surface of the base and the vault.
Figure 12:
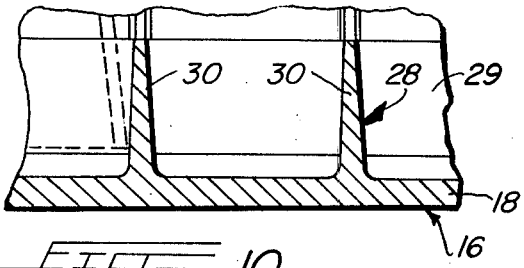
Figure 13:
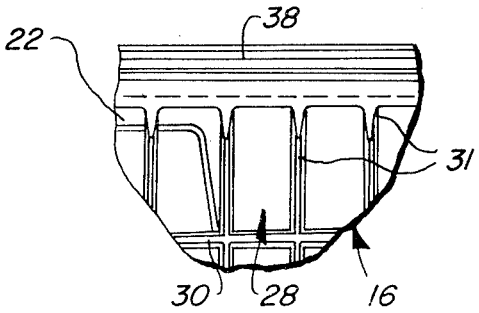

FIG. 12 is an enlarged fragmentary sectional view of the area encircled as "FIG. 12" in FIG. 4, illustrating certain parts of the pattern of reticulated ribs on the inner surface of the base of the vault; and FIG. 13 is an enlarged fragmentary sectional view of the area encircled as "FIG. 13" in FIG. 3 and further illustrating part of the pattern of reinforcing ribs on the inner surface of the base of the new vault.

DETAILED DESCRIPTION OF THE INVENTION

A typical and preferred embodiment of the invention is illustrated in the drawings, wherein it is generally indicated at 15, and comprises a base 16 and a dome 17, both of which may be molded of any suitable plastic resinous molding material such, for example, as polystyrene, or the like.

As shown in the drawings, the base 16 includes a bottom wall 18, outwardly and upwardly flared side walls 19 and outwardly and upwardly flared end walls 20. The dome 17 includes a top wall 21, outwardly and downwardly flared side walls 22 and outwardly and downwardly flared end walls 23.

The base 16 has a series of parallel reinforcing spaced ribs 24 which are formed integral with the side walls 19 on the inner surface thereof and each of the end walls 20 of the base 16 has similar parallel spaced reinforcing ribs 25 formed integral therewith on the inner surfaces thereof.

Similarly, the cover or dome 17 has a series of parallel reinforcing ribs 26 formed integral with and on the inner surfaces of the side walls 22 of the cover or dome 17 and each of the end walls 23 of the cover or dome 17 has a series of parallel reinforcing ribs 27 formed integral therewith on the inner surfaces thereof.

The bottom wall 18 of the base 16 has a pattern 28 of reticulated reinforcing ribs formed integral therewith on the inner and upper surface of the bottom wall 18 and this pattern 28 of reticulated reinforcing ribs includes a series of parallel longitudinally extending reinforcing ribs 29 and a series of parallel transversely extending reinforcing ribs 30 which intersection with and are integrally molded to the longitudinally extending reinforcing ribs 29.

Similarly, the top wall 21 of the cover or dome 17 has a pattern 31 of reticulated reinforcing ribs formed integrally therewith on the inner and lower surface thereof and this pattern 31 of reinforcing ribs includes a series of parallel longitudinally extending reinforcing ribs 32 and a series of parallel transversely extending reinforcing tibs 33 which intersect with and are integrally molded to the longitudinally extending reinforcing ribs 32.

Figure 9:
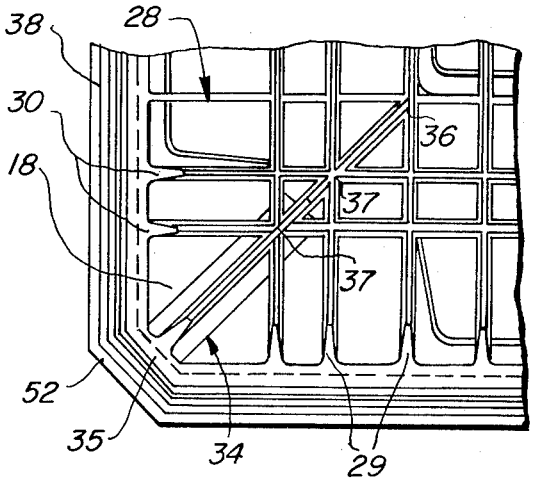
FIG. 9 is an enlarged fragmentary plan view of the area encircled as "FIG. 9" in FIG. 3, illustrating parts of the reinforcing structure at the bottom corners on the inner surface of the base of the vault.
Figure 10:
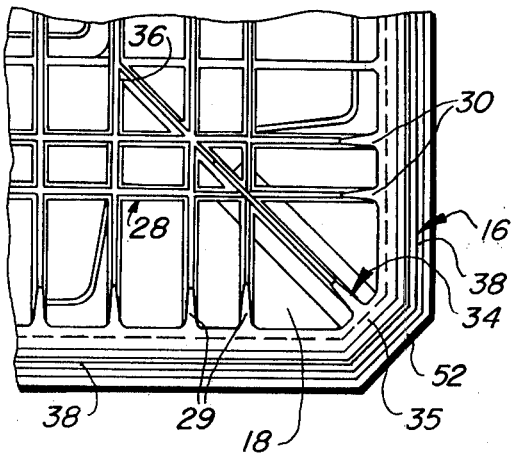
FIG. 10 is an enlarged fragmentary plan view, similar to FIG. 9, of the area encircled as "FIG. 10" in FIG. 3, illustrating the reinforcing structure at another bottom corner in the base of the vault.

The bottom wall 18 of the base 16 has a corner reinforcing strut structure 34 at each corner thereof. Each of these corner reinforcing structures is molded integrally with the bottom wall 18 of the base 16 and extends diagonally inwardly from the corner, as 35, of the base 16 partially across the inner surface of the bottom wall 18 of the base 16 to a point 36 (FIGS. 9 and 10) where it merges into the reticulated pattern 28 of reinforcing ribs 29 and 30 to which it is integrally molded along its length, as at 37; each of the reinforcing strut structures 34 being somewhat wider near the corners 35 of the base 16 and tapering inwardly toward its end as at 36 (FIGS. 9 and 10). As is also shown in FIGS. 9 and 10 of the drawings, each of the corner reinforcing strut structures 34 extends rightangularly inwardly from and relative to an angularly extending corner portion 52 of the base 16 of the vault 15, thereby further enhancing the structural strength of the base 16 of the vault 15 at the corners thereof.

Figure 7:
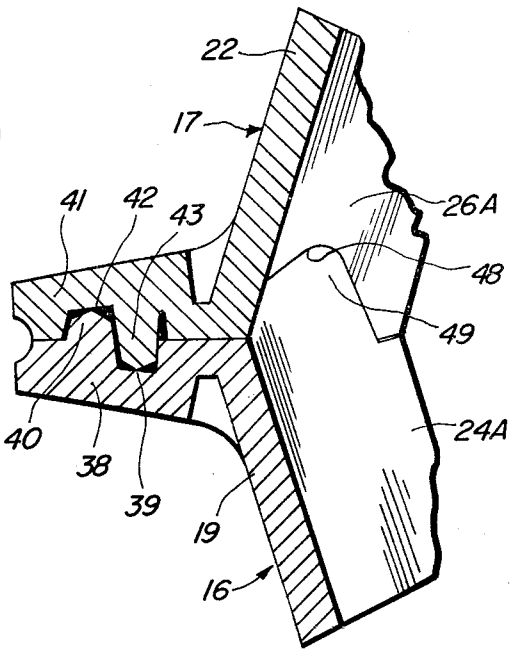
FIG. 7 is an enlarged fragmentary sectional view of the parts shown in FIG. 6 but showing the outwardly extending marginal or peripheral sealing flanges in assembled and sealed position.
Figure 6:
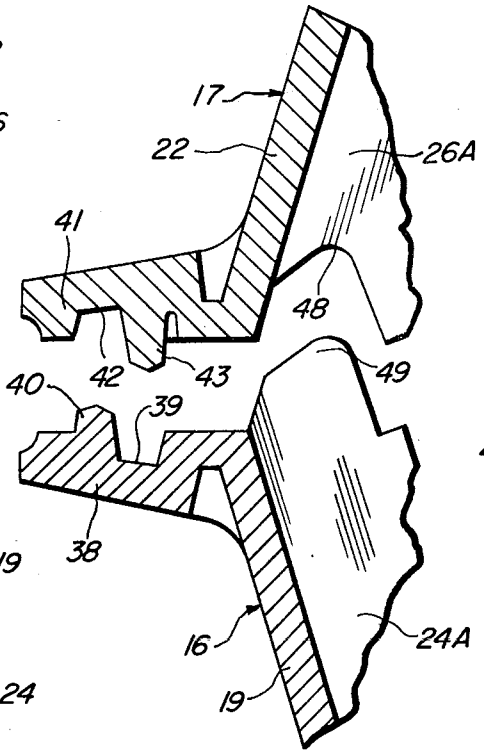
FIG. 6 is an enlarged fragmentary exploded sectional view of the side walls of the base and dome of the new vault and illustrating the outwardly extending marginal or peripheral sealing flanges thereon.
Figure 5:
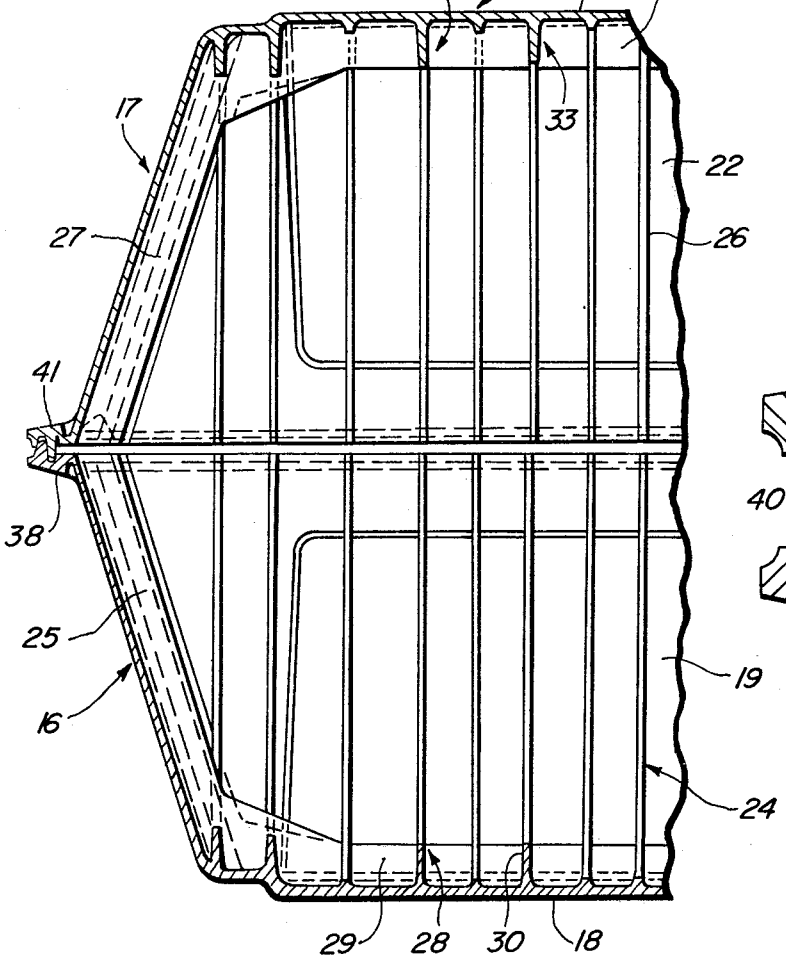
FIG. 5 is an enlarged fragmentary sectional view on line 5—5 in FIG. 1 illustrating certain of the reinforcing structures in the base and dome of the new vault and the mating marginal or peripheral sealing flanges thereon.

Each of the outwardly and upwardly flared side walls 19 and end walls 20 of the base 16 has an outwardly extending marginal or peripheral sealing flange 38 formed integral therewith at the upper edge thereof and each of these marginal or peripheral flanges 38 has a longitudinally extending sealing tongue 40 formed thereon on its upper surface (FIGS. 6 and 7).

Similarly, each of the side walls 22 of the cover or dome 17 has an outwardly extending marginal or peripheral sealing flange 41 formed integral therewith at its lower edge and each of these marginal or peripheral sealing flanges 41 has a longitudinally extending sealing groove 42 formed therein and a longitudinally extending sealing tongue 43 formed thereon (FIGS. 6 and 7).

As is readily apparent, the position and arrangement of the mating and coacting sealing grooves 39 and 42 and sealing tongues 40 and 43, as described above, and as best shown in FIGS. 6 and 7 of the drawings, may be varied in that the sealing groove 42 and the sealing tongue 43 on the cover or dome 17 may be reversed with the sealing groove 42 arranged inwardly of the sealing tongue 43 on the marginal or peripheral sealing flange 41, rather than outwardly thereof as shown in the illustrative arrangement shown in FIGS. 6 and 7 of the drawings and, similarly, the sealing tongue 40 on the sealing flange 38 of the base 16 may be arranged outwardly of the sealing tongue 41, if desired.

Each of the side walls 19 of the base 16 has a series of spaced geometrically shaped recesses 44 formed therein, which are shown as being generally rectangular in shape, but may have any desired geometrical shape or form, and each of the side walls 22 of the base 16, has at least a pair of similar geometrically shaped recesses 45 formed therein. Similarly, each of the end walls 23 of the dome 17 has at least a pair of spaced geometrically shaped recesses 47 formed therein.

Figure 1:
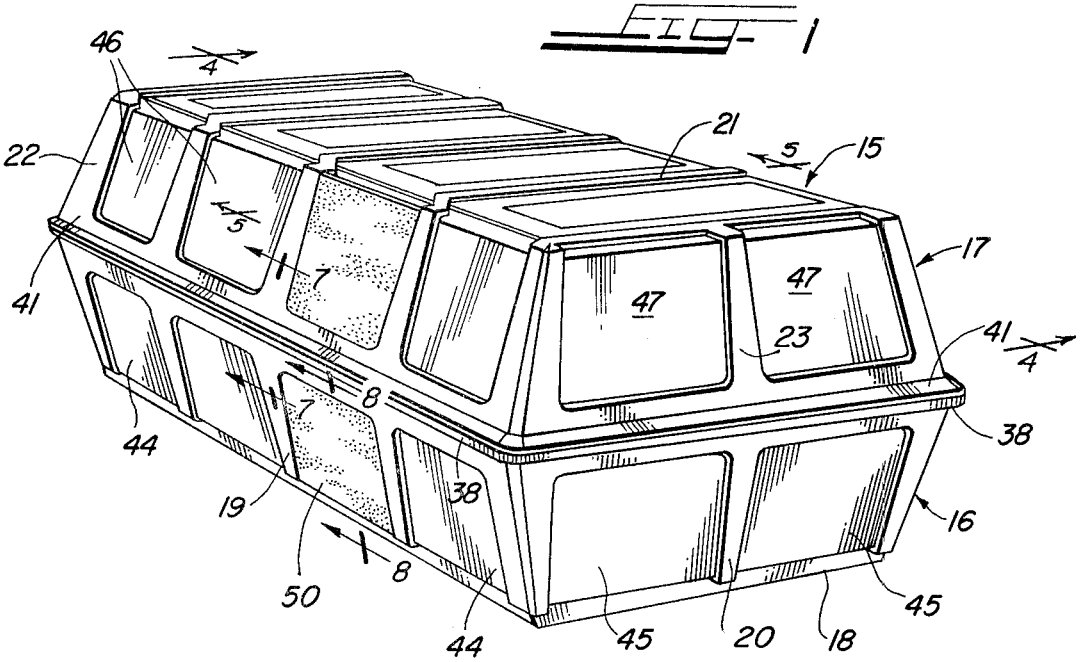
FIG. 1 is a perspective view of the new burial vault in assembled position.
Figure 2:
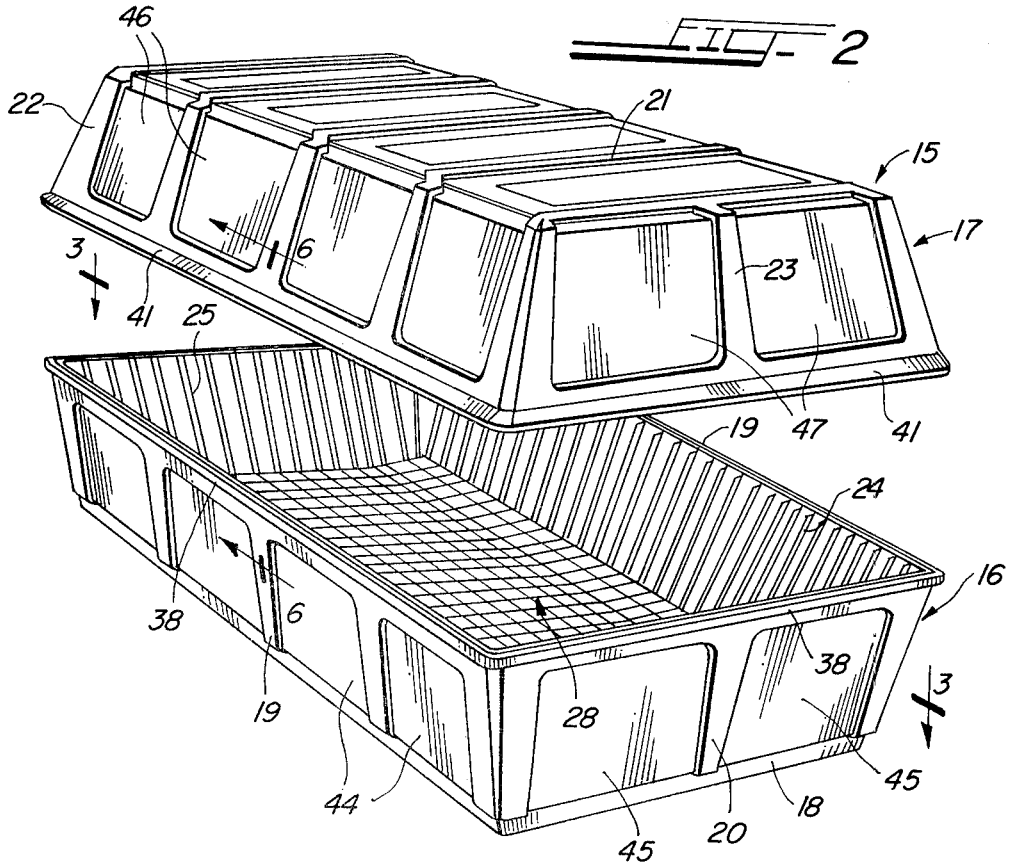
FIG. 2 is an exploded perspective view of the base and the cover or dome of the new burial vault.
Figure 8:
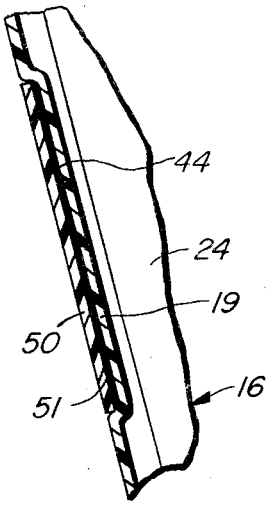
FIG. 8 is a fragmentary sectional detail view on line 8—8 in FIG. 1, illustrating the construction of one of the geometrically shaped recesses which are formed on the side and end walls of the base and in the cover or dome of the vault and showing one of the correspondingly geometrically shaped decorative panels or inserts adhesively mounted therein.
Figure 11:
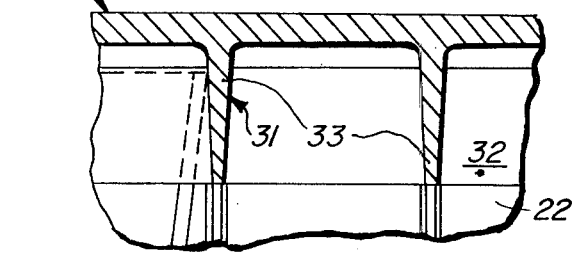
FIG. 11 is an enlarged fragmentary sectional view of the are encircled as "FIG. 11" in FIG. 4 and illustrating certain parts of the pattern of reticulated reinforcing ribs on the inner surface of the dome or cover of the vault.

As shown in FIGS. 1 and 8 of the drawings, a colored geometrically shaped decorative panel or insert 50 may be arranged in each of the correspondingly geometrically shaped recesses 44 and 45 in the side and end walls 19 and 20, respectively, of the base 16, and similar colored geometrically shaped decorative panels or inserts 50 may be arranged in each of the correspondingly geometrically shaped recesses 46 and 47 formed in the side walls 22 and end walls 23 of the cover or dome 17. The decorative panels or inserts 50 may be constructed from any suitable material such as formed sheet plastic, formed sheet metal, resin-coated paper, film, or the like.

As shown in FIG. 8 of the drawings, each of the colored geometrically shaped panels or inserts, as 50, may be adhesively mounted in a corresponding one of the geometrically shaped recesses, as 44, by means of a suitable adhesive 51.

It will be noted (FIGS. 6 and 7) that at least certain of the reinforcing ribs 26A on the inner surfaces of the side walls 22 of the cover or dome 17 have a latching groove 48 formed in the lower edge thereof and that a complementary and correspondingly shaped latching tongue 49 is formed on the upper edge of at least certain of the reinforcing ribs 24A on the inner surfaces of the side walls 19 of the base 16. A similar arrangement of the latching grooves 48 and latching tongues 49 may be provided on the inner surfaces of the end walls 23 of the cover or dome 17 and on the end walls 20 of the base 16, if desired, and the number of these latching tongues and grooves may be varied, dependent upon the size of the vault and other factors.

In the use of the new burial vault 15, after the funeral service, the casket with the remains of the deceased may be placed in the base 16 and the sealing grooves 39 and 42 in the outwardly extending marginal or peripheral sealing flanges 38 and 41 on the side and end walls 19 and 20 of the base and on the side walls 22 and end walls 23 of the cover or dome 17, respectively, may be filled with a suitable sealing adhesive such, for example, as so-called butyl rubber adhesive sealing tape, as is well known in the art. The cover or dome 17 may then be arranged in proper mating position over the base 16 with the sealing tongues 40 and 43 fitting into the sealing grooves 42 and 39, respectively, thereby providing an effecient hermetic and water-resistant seal between the base 16 and the cover or dome 17.

During the operation of assembling the base 16 and the dome 17 in mating relationship, as described above, the latching tongues 49 on the reinforcing ribs as 24A, on the inner surfaces of the side walls 19 of the base 16 fit into and coact with and are latchingly engaged in the corresponding shaped and coacting latching grooves 48 in the reinforcing ribs, as 26A, on the inner surfaces of the side walls 22 of the cover or dome 17, (FIGS. 6 and 7), thereby securely latching the base 16 and the cover or dome 17 together and enhancing the structural strength of the thus assembled burial vault 15.

In addition, the reticulated pattern 28 of reinforcing ribs 29 and 30 on the upper surface of the bottom wall 18 of the base 16 and the reinforcing ribs 24 and 25 on the side walls 19 and end walls 20 of the base 16 enhance the structural strength of the base 16. Similarly, the reticulated pattern 31 of reinforcing ribs 32 and 33 on the inner surface of the top wall 21 of the dome 17, and the reinforcing ribs 26 and 27 on the side walls 22 and 23, respectively, of the cover or dome 17, enhance the structural strength of the cover or dome 17, and all of these reinforcing rib structures cooperate to enhance the structural strength of the assembled vault 15.

Moreover, the diagonally extending reinforcing strut structures 34 at the bottom corners of the base 16 further enhance the structural strength of the base 16 and of the assembled vault 15.

It will thus be seen that the present invention provides a new and improved molded plastic resinous burial vault having the desirable advantages and characteristics, and accomplishing its intended objects, including those hereinbefore pointed out and others which are inherent in the invention.

I claim:

1. A burial vault comprising (a) a molded plastic resinous base including
  (1) a bottom wall;
  (2) side walls each having
    a. an inner surface; and
  (3) end walls each having
    a. an inner surface;

(b) a molded plastic resinous cover or dome including
  (1) a top wall having
    a. an inner surface;
  (2) side walls; and
  (3) end walls each having
    a. an inner surface;

(c) at least certain of the said side walls and end walls of the said base and of the said cover or dome having a series of parallel reinforcing ribs on the said inner surfaces thereof;

(d) at least certain of the said reinforcing ribs on the said base and on the said cover or dome having coacting latching grooves and latching tongues formed therein; and (e) said latching grooves and latching tongues in the assembled position of the said base and cover or dome being latchingly engaged with each other to retain the said base and the said cover or dome in securely assembled relationship.

2. A burial vault comprising (a) a molded plastic resinous base including
  (1) a bottom wall;
  (2) side walls; and
  (3) end walls;

(b) a molded plastic resinous dome-shaped cover including
  (1) a top wall;
  (2) side walls; and
  (3) end walls;

(c) the said side walls and end walls of the said base extending upwardly from and being inclined outwardly from the said bottom wall of the said base;

(d) the said side walls and end walls of the said dome-shaped cover extending downwardly from and being inclined outwardly from the said top wall of the said dome-shaped cover;

(e) each of the said side walls and end walls of the said base having
  (1) a marginal or peripheral upper edge portion;

(f) the said base including
  (1) an outwardly extending marginal or peripheral sealing flange formed integrally thereon and extending around and outwardly of the said marginal or peripheral edge portions of the said side walls and end walls of the said base;

(g) each of the said side walls and end walls of the said dome-shaped cover having
  (1) a marginal or peripheral lower edge portion;

(h) the said molded plastic resinous dome-shaped cover having an outwardly extending marginal or peripheral sealing flange formed integrally therewith and extending around and outwardly of the said marginal or peripheral lower edge portions of the said side walls and end walls of the said dome-shaped cover;

(i) the said outwardly extending marginal or peripheral sealing flanges on the said base and on the said dome-shaped cover having formed therein mating and coacting sealing grooves and sealing tongues receivable in the said sealing grooves;

(j) the said dome-shaped cover being assembled over the said base with the said marginal or peripheral sealing flange of the said dome-shaped cover being disposed over and in mating relationship with the said marginal or peripheral sealing flange of the said base and with the sealing tongues being adapted to be hermetically sealed in the said sealing grooves by a water-resistant sealing composition;

(k) the said bottom wall of the said base including
  (1) an inner or upper surface having formed and molded integrally therein
  (2) a reticulated pattern of reinforcing ribs including
    a. a series of generally parallel longitudinally extending reinforcing ribs; and
    b. a series of generally parallel transversely extending reinforcing ribs intersecting with and being integrally molded to the said generally parallel longitudinally extending reinforcing ribs;

(l) the said upwardly and outwardly inclined side walls and end walls of the said base having generally parallel reinforcing ribs molded integrally therewith on their inner surfaces;

(m) the said top wall of the said dome-shaped cover including
  (1) an inner or lower surface having formed and molded integrally therein
  (2) a reticulated pattern of reinforcing ribs including
    a. a series of generally parallel longitudinally extending reinforcing ribs; and
    b. a series of generally parallel transversely extending reinforcing ribs intersecting with and being integrally molded to the said generally parallel longitudinally extending reinforcing ribs on the said inner or lower surface of the said dome-shaped cover; and (n) the said downwardly and outwardly inclined side walls and end walls of the said dome-shaped cover having generally parallel reinforcing ribs molded integrally therewith on their inner surfaces.

3. A burial vault as defined in claim 2 in which (a) the said bottom wall of the said base includes
  (1) angularly extending corner portions extending between the said side walls and the said end walls of the said base; and in which (b) the said bottom wall of the said base has
  (1) molded integrally therewith on its said inner or upper surface a reinforcing strut structure at each of the said angularly extending corner portions of the said base; and in which
  (2) the said reinforcing strut structures extend diagonally inwardly from the said angularly extending corner portions across a portion of the said inner or upper surface of the said bottom wall of the said base.

4. A burial vault comprising (a) a molded plastic resinous base including
  (1) a bottom wall;
  (2) opaque closed side walls each having
    a. an outer surface; and
  (3) opaque closed end walls each having
    a. an outer surface;

(b) a molded plastic resinous dome-shaped cover including
  (1) a top wall;
  (2) opaque closed side walls; and
  (3) opaque closed end walls;

(c) at least certain of the said opaque closed side walls and end walls of the said base having geometrically-shaped recesses formed in the said outer surfaces thereof;

(d) opaque decorative panels geometrically shaped to correspond to the shape of the said geometrically shaped recesses in the said opaque closed side walls and end walls of the said base and adhesively and permanently mounted in the said geometrically shaped recesses in the said opaque closed side walls and end walls of the said base;

(e) the said opaque closed side walls and the said opaque closed end walls of the said dome-shaped cover having outer surfaces;

(f) at least certain of the said opaque closed side walls and end walls of the said dome-shaped cover having
  (1) geometrically shaped recesses formed therein; and
  (2) opaque decorative panels geometrically shaped to correspond to the shape of the said recesses in the said opaque closed side walls and end walls of the said dome-shaped cover and adhesively and permanently mounted in the said geometrically-shaped recesses in the said opaque side walls and end walls of the said dome-shaped cover.

* * * * *